US008205873B2

(12) United States Patent
Chung et al.

(10) Patent No.: US 8,205,873 B2
(45) Date of Patent: Jun. 26, 2012

(54) MEDIA PICK SYSTEM AND MEDIA PICK METHOD THEREOF

(75) Inventors: Ming-Chung Chung, Emei Township, Hsinchu County (TW); Ying-Jui Lee, Sindian (TW); Hsin-Chang Chen, Hengchun Township, Pingtung County (TW)

(73) Assignees: Silitek Electronic (Guangzhou) Co., Ltd., Guangzhou (CN); Lite-On Technology Corporation, Taipei (TW)

( * ) Notice: Subject to any disclaimer, the term of this patent is extended or adjusted under 35 U.S.C. 154(b) by 0 days.

(21) Appl. No.: 12/903,323

(22) Filed: Oct. 13, 2010

(65) Prior Publication Data

US 2011/0272878 A1 Nov. 10, 2011

(30) Foreign Application Priority Data

May 5, 2010 (CN) ..... 2010 1 0163008

(51) Int. Cl.
*B65H 3/06* (2006.01)

(52) U.S. Cl. ..... 271/118; 271/117

(58) Field of Classification Search ..... 271/114, 271/117, 118, 121, 122, 124
See application file for complete search history.

(56) References Cited

U.S. PATENT DOCUMENTS

2008/0122162 A1 * 5/2008 Bokelman et al. ..... 271/124

FOREIGN PATENT DOCUMENTS

JP 63-258332 * 10/1988

* cited by examiner

*Primary Examiner* — Gerald McClain
*Assistant Examiner* — Thomas Morrison
(74) *Attorney, Agent, or Firm* — Li&Cai Intellectual Property (USA) Office

(57) ABSTRACT

A media pick system includes a pick-up rack, a pick-up roller, a separate roller, a swing gear arm, a swing gear lever, and a part of action. While the separate roller and the swing gear arm are driven to rotate, the swing gear lever would be driven to rotate. Therefore, while the torque generated on the pick-up rack by the part of action so that the pick-up rack could be lifted up or pushed down to pick up the media.

7 Claims, 7 Drawing Sheets

MEDIA PICK SYSTEM AND MEDIA PICK METHOD THEREOF

BACKGROUND OF THE INVENTION

1. Field of the Invention

The present invention particularly relates to a media pick system which has a pick-up rack with an adjustable torque.

2. Description of Related Art

Printers are indispensable output devices of current information products. In general, the printing quality is determined by the document printing resolution, the media feeding speed, stability and reliability. Stability and reliability would be reached by the media pick system with a high feeding success rate. For meeting the goal of high success rate of paper feeding and the fine printing quality, the media pick system design of the printer would be very important.

For feeding papers, the conventional pick-up mechanism mostly provides a feed roller at an end of a media pick-up rack. For example, while the media pick-up rack touches the paper with the feed roller, the papers could be delivered one by one into the working area with the rotating of the feed roller.

For example, a conventional design of the media pick system applies a fixed torque on the pick-up rack, and sets an angle of the pick-up rack with linked gears or racks for feeding paper. However, since the mentioned pick system is intricately assembled with many components, the productivity in manufacturing the pick system would be very low. Moreover, the drive motor of the conventional pick system has to provide full power output, so that the pick system fails to efficiently save the energy.

SUMMARY OF THE INVENTION

In view of the aforementioned issues, the present invention provides a media pick system to modify the torque direction generated on the pick-up rack by the part of action. Thus, the structure of the media pick system would be simplified and easily modularized for degrading the complexity and improving the reliability of the pick mechanism.

For achieving the above-mentioned objectives, the present invention provides a media pick system having a pick-up rack, a swing gear arm, and a swing gear lever. The pick-up rack having a first feed roller and a second feed roller works between a pick-up position and a non-pick-up position. The swing gear arm has a swing gear linked to the second feed roller. The swing gear lever has an end connected to the swing gear arm and another end connected to a part of action located at one eccentric spindle of the swing gear lever. Therefore, while the second feed roller and the swing gear arm are driven to rotate toward to a first direction, the swing gear of the swing gear arm engaged with a gear portion drives the gear lever for actuating the part of action. The torque generated by the part of action would move the gear lever to the pick-up position, so that the first feed roller touches the paper. While the second feed roller and the swing gear arm are driven to rotate toward a second direction, the swing gear of the swing gear arm engaged with the gear portion would be restored. Then, the torque generated by the part of action would move the pick-up rack to the none-pick-up position, so that the first feed roller would be away from the paper.

Moreover, the present invention provides a media pick method including following steps includes keeping the pick-up rack at the none-pick-up position by using the torque generated by the part of action, driving the second feed roller and the swing gear arm to rotate forward to the first direction and actuating the part of action. The pick-up rack would be moved from the pick-up position to the none-pick-up position by the torque generated by the part of action. Then, the first feed roller is able to touch the paper. The second feed roller and the swing gear arm can be driven to rotate to the second direction. The swing gear of the swing gear arm would be restored by actuating the part of action, while the swing gear of the swing gear arm engaged with the gear portion actuates the swing gear arm rotating toward to the second direction. Thus, the first feed roller would be away from the paper, since the pick-up rack return back to the none-pick-up position from pick-up position.

The present invention has following advantages. The pick-up rack is able to be lifted up or pushed down while the torque direction generated by the part of action on the pick-up rack is changed. The structure of the media pick system would be more simplifier comparing with the conventional media pick system since the complicated structure would not exist in present invention. The goal of paper pick-up and paper feeding would be achieved by the modularized mechanism.

For further understanding of the techniques and features of the present invention, please refer to the following detailed descriptions and appended drawings of the present invention. However, the appended drawings are merely provided for reference and illustration which have no restrictions to the present invention.

DETAILED DESCRIPTION OF THE PREFERRED EMBODIMENTS

Figure 1:
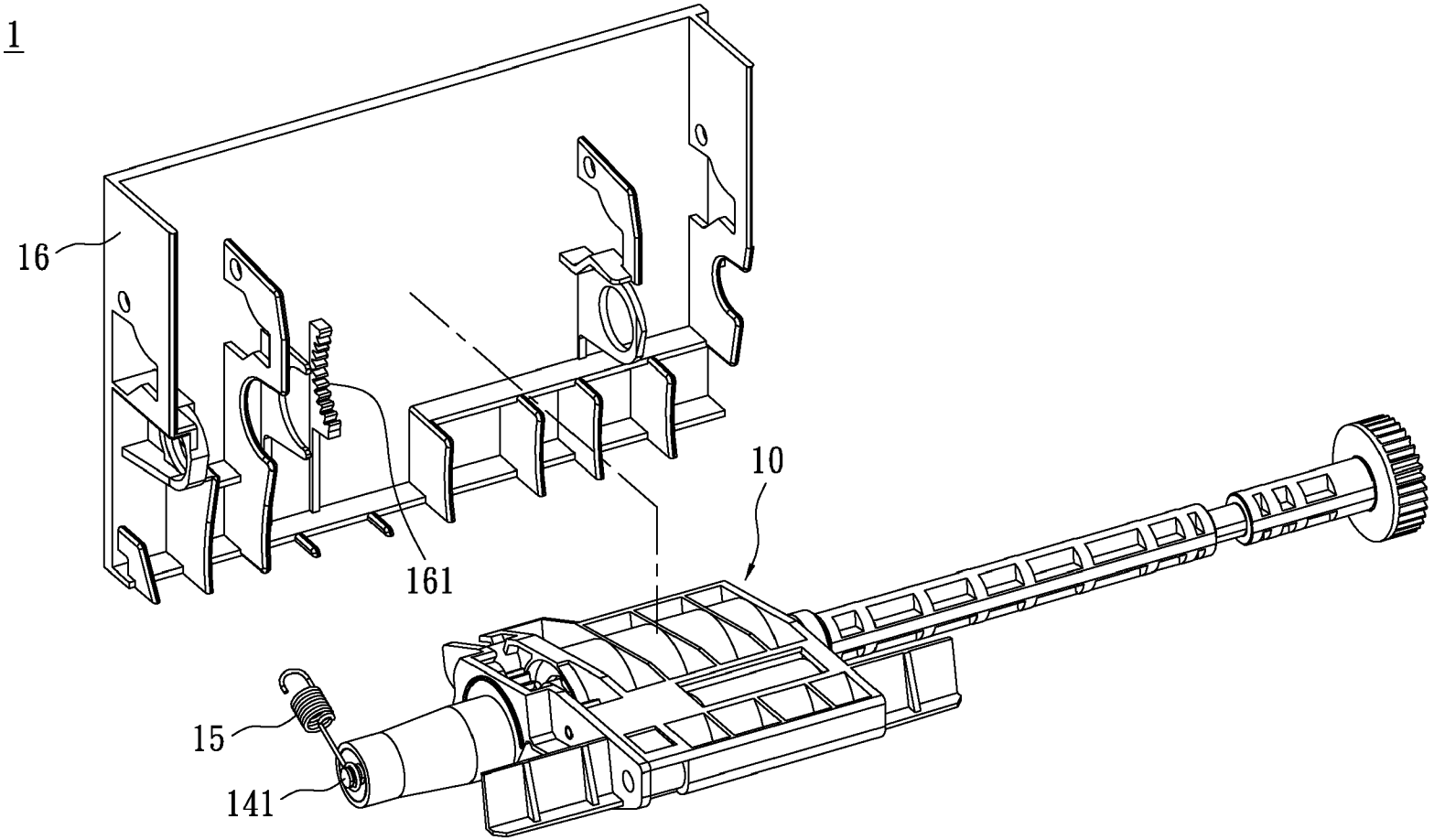
FIG. 1 is a perspective view of the present invention.
Figure 1A:
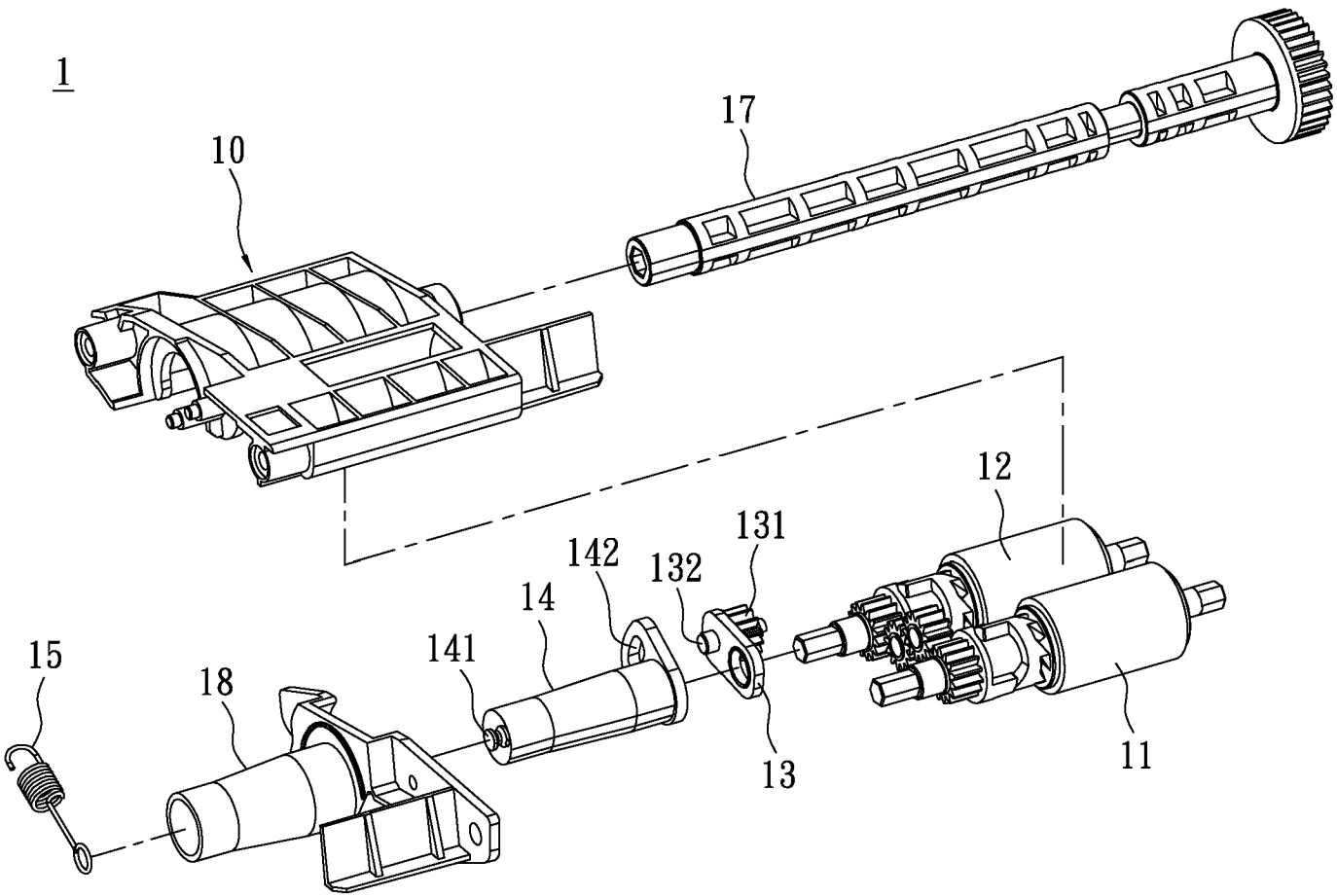
FIG. 1A is an explosion view of the present invention.

The present invention provides a media pick system, which alternately utilizes the positive and negative torque to lift up or push down the pick-up rack, so that the feed roller could touch or be away from media of paper. Referring now to FIGS. 1 and 1A, in which a media pick system 1 includes a pick-up rack 10, a first feed roller 11, a second feed roller 12, a swing gear arm 13, a swing gear lever 14 and a part of action 15. The media pick system 1 could be applied to the printers, the photocopiers, the multi-function office machine products, or the likes.

Referring back to FIG. 1, the pick-up rack 10 is a base member of the media pick system 1 according to the present invention. The first feed roller 11 and the second feed roller 12 are arranged on the pick-up rack 10. The pick-up rack 10 rotates around an axis 121 of the second feed roller 12 and swings between a pick-up position and a non-pick-up position. Therefore, the first feed roller 11 can touch or be away from the media of paper. The first feed roller 11 is called a pick-up roller, while the second feed roller 12 is a separate roller.

The swing gear arm 13 is linked to the second feed roller 12 and the swing gear arm 13 and the second feed roller 12 rotate clockwise or counterclockwise in a synchronous manner. The swing gear arm 13 includes a swing gear 131 and a protrusion 132.

Figure 2A:
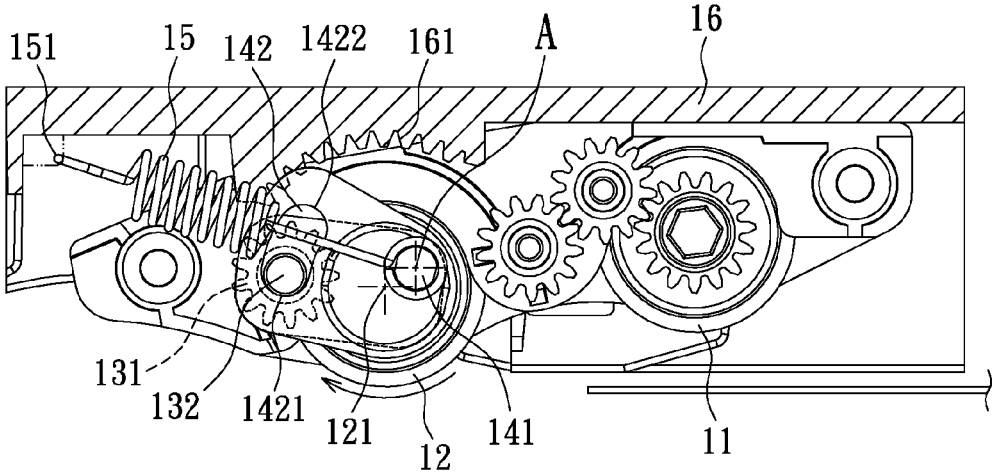
FIGS. 2A to 2C are cross-sectional profiles illustrating a pick-up rack swinging from a non-pick-up position to a pick-up position.

The swing gear lever 14 has an end connected to the swing gear arm 13 and another end connected to a part of action 15. The part of action 15, which could be a spring, has an end connected to an eccentric spindle 141 of the swing gear lever 14 and another end connected to an end 151, as shown in FIG. 2A. Thus, when the swing gear lever 14 rotates, the eccentric spindle 141 generates a torque relative to the axis 121 of the second feed roller 12. In this embodiment, the swing gear lever 14 includes an arc slot 142 corresponding to the protrusion 132. The protrusion 132 of the swing gear arm 13 abuts against the arc slot 142 to rotate the swing gear lever 14. By changing the position of the eccentric spindle 141, repeating movement between a pick-up position B and a non-pick-up position A illustrated in FIGS. 2A and 2C, torques with different directions applied to the pick-up rack 10 is offered. When the swing gear arm 13 rotates, the swing gear 131 of the swing gear arm 13 engages with the gear portion 161 to generate a first or a second directional force, so that the gear lever 14 is driven to move clockwise or counterclockwise. The gear portion 161 may have an arc shape. The part of action is driven by the eccentric spindle 141 to move or restore.

In another way, the media pick system further includes a lid 16 disposed over the pick-up rack 10 and a cover 18 assembled to a lateral side of the pick-up rack 10. The gear portion 161 is arranged at an inner face of the lid 16, and corresponding to the swing gear 131 of the swing gear arm 13. The swing gear lever 14 penetrates through the cover 18 so that two ends are out of the cover 18.

Figure 2B:
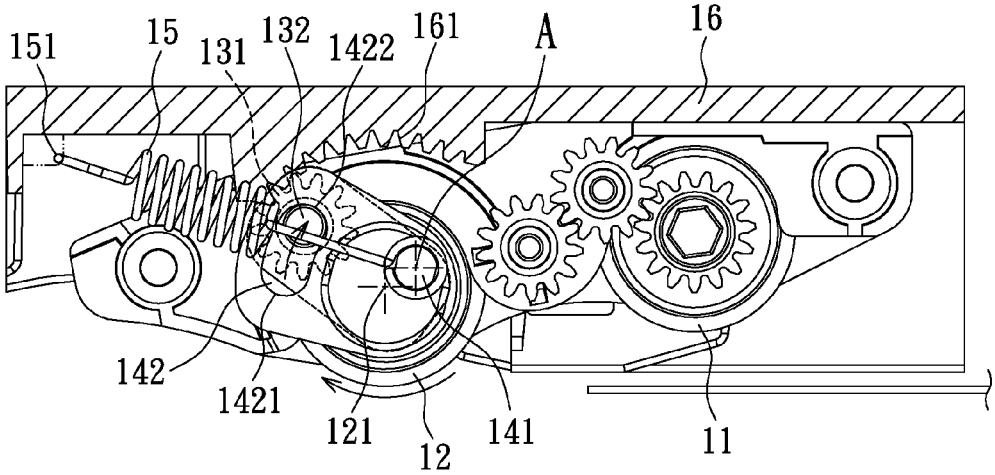
Figure 2C:
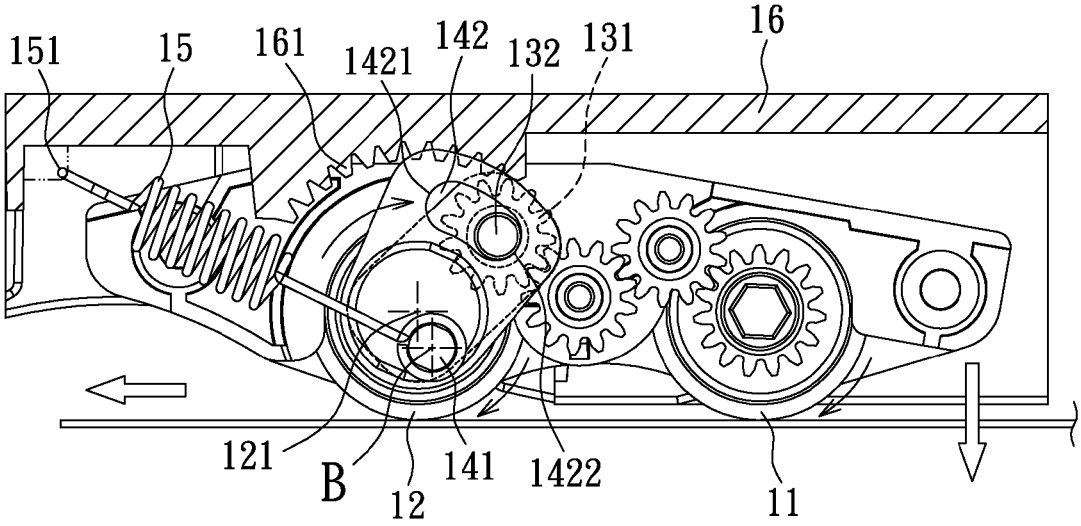

With respect to FIGS. 2A to 2C, the pick-up rack 10 of the media pick system 1 swings to the pick-up position, and the first feed roller 11 contacts the media of paper. First, a force is applied to drive the second feed roller 12 and the swing gear arm 13 clockwise rotates around a first direction. In such an embodiment, the force would be provided by a motor, and delivered by a driving spindle 17 to drive the second feed roller 12 and swing gear arm 13 swing clockwise.

Figure 4A:
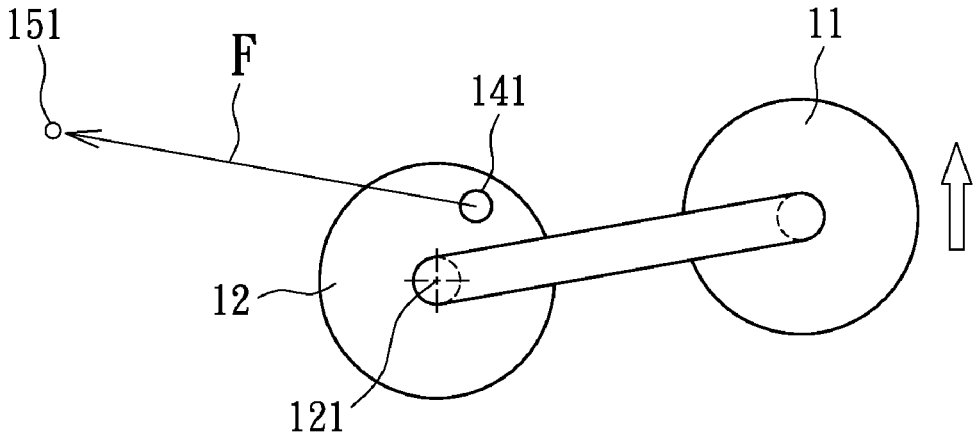
FIGS. 4A and 4B are sketches showing the positive torque and negative torque applied to the pick-up rack.
Figure 4B:
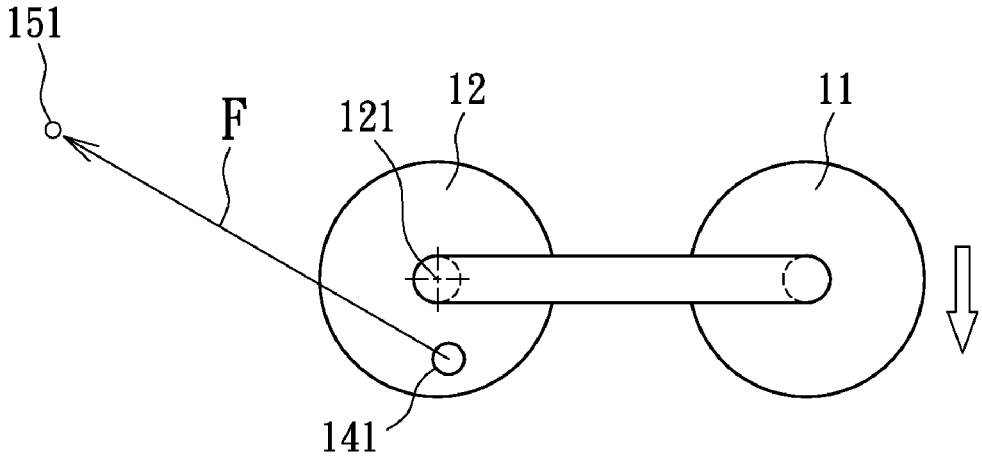

Further referring to FIGS. 4A and 4B, during the process of the rotation, the swing gear 131 of the swing gear arm 13 engages with the gear portion 161 to generate the first-directional driving force, clockwise force, so that the swing gear lever 14 could be driven to rotate clockwise. When the swing gear 131 of the swing gear arm 13 engages with the gear portion 161 along the first direction, the protrusion 132 of the swing gear arm 13 moves toward and forces a second end 1422 of the arc slot 142 from a first end 1421 thereof to generate the first-directional driving force. Meanwhile, the eccentric spindle 141 drives the part of action 15 to rotate around the axis 121 of the second feed roller 12 because the eccentric spindle 141 moves from the non-pick-up position A to the pick-up position B. Therefore, the torque to the axis 121 formed by the part of action 15 will alter from a lift-up status to a push-down status, and the pick-up rack 10 swing to the pick-up position and the first feed roller 11 contacts the media of paper. Via the change of the forcing positions, the counterclockwise torque, as shown in FIG. 4A, applied to the pick-up rack 10 is altered to be the clockwise torque, as shown in FIG. 4B, to push down the pick-up rack 10.

On the contrary, FIGS. 3A to 3D illustrating the pick-up rack 10 swings to the non-pick-up position. A force provided by the motor, delivered by the driving spindle 17, drives the second feed roller 12 and the swing gear arm 13 to counterclockwise rotate around second direction.

During the process of the rotation, the swing gear 131 of the swing gear arm 13 engages with the gear portion 161 to generate the counterclockwise driving force, so as to drive the swing gear lever 14 rotates counterclockwise. In this case, when the swing gear 131 of the swing gear arm 13 engages with the portion 161, the protrusion 132 of the swing gear arm 13 moves toward and forces the first end 1421 of the arc slot 142 from the second end 1422 to generate the second-directional driving force. Meanwhile, the eccentric spindle 141 moves the part of action 15 back to original position, because the eccentric spindle 141 moves from the pick-up position B to the non-pick-up position A. Therefore, the torque to the axis 121 formed by the part of action 15 will alter from a push-down status to a lift-up status, and the pick-up rack 10 swings to the non-pick-up position and the first feed roller 11 stays away from the media of paper. Via the change of the forcing positions, the counterclockwise torque, as shown in FIG. 4A, applied to the pick-up rack 10 is altered to be the clockwise torque, as shown in FIG. 4B, to lift up the pick-up rack 10 and to keep the first feed roller 11 away from the media of paper.

The present invention which discloses a media pick method including the following steps which are applying the part of action 15 to the pick-up rack 10 to generate a torque for keeping the pick-up rack 10 at a non-pick-up position A. Referred in FIGS. 2A and 4A, the part of action 15 is a spring, the elastic resistance F applied to the non-pick-up position A is defined as a counterclockwise torque to the axis 121, which is a negative torque lifting the pick-up rack 10 to keep the pick-up rack 10 at the non-pick-up position A.

In a pick-up status, the driving spindle 17 operated by the motor drives the second feed roller 12 and the swing gear arm 13 rotate clockwise along the first direction. The swing gear 131 of the swing gear arm 13 engages with the gear portion 161 to generate the clockwise driving force which is the first directional driving force. For example, the protrusion 132 of the swing gear arm 13 forces on the first end 1421 of the arc slot 142 in order to rotate the swing gear lever 14 clockwise. Via the linkage of the eccentric spindle 141 to the part of action 15, the eccentric spindle 141 rotates clockwise and moves from the non-pick-up position A to the pick-up position B. The elastic resistance F applied to the pick-up position B, as illustrated in FIGS. 2C and 4B, is defined a clockwise torque to the axis 121, which is a positive torque, and push the pick-up rack 10 down to swing the pick-up rack 10 to the pick-up position B. Then, the first feed roller 11 touches the media of the paper.

Figure 3A:
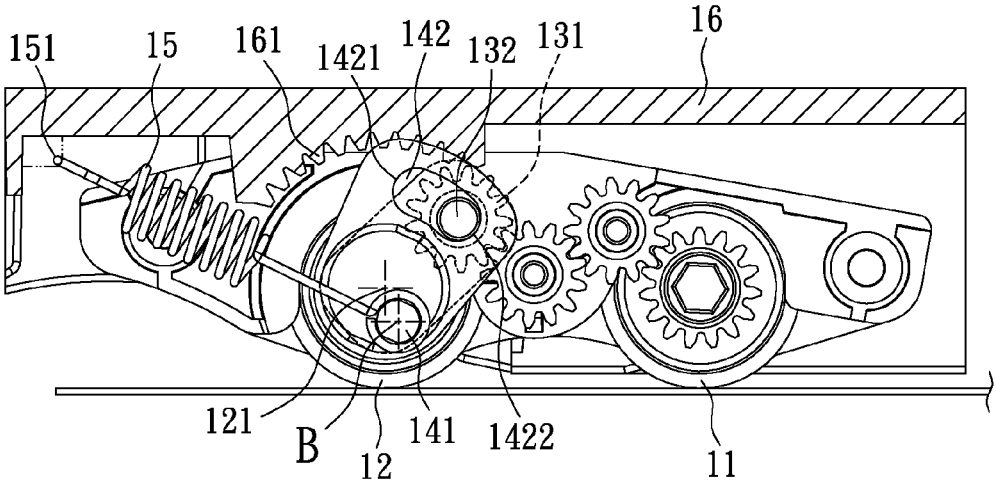
FIGS. 3A to 3D are cross-sectional profiles illustrating the pick-up rack restoring from the pick-up position to the non-pick-up position.
Figure 3B:
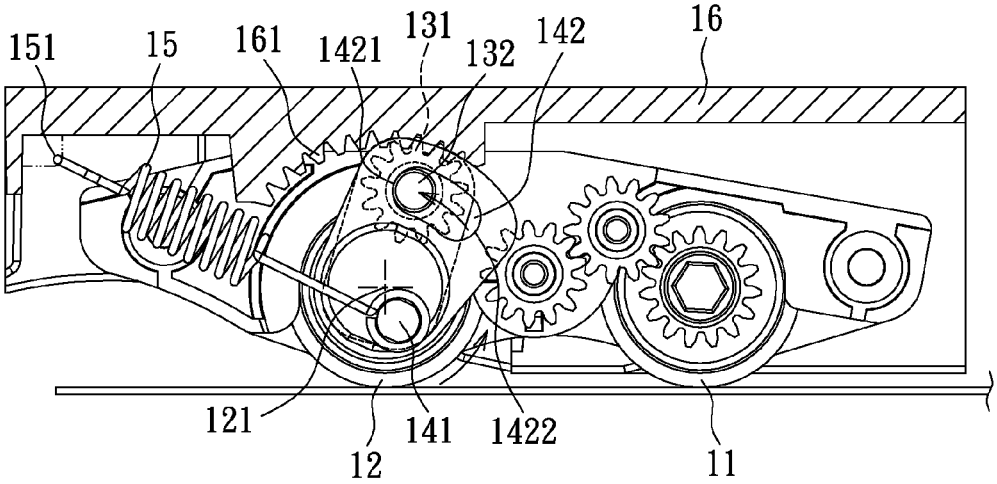
Figure 3C:
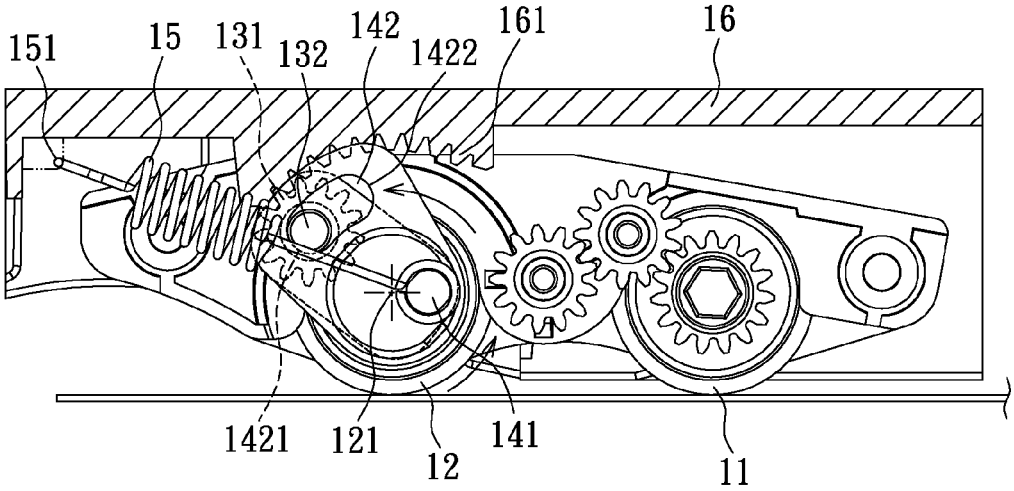
Figure 3D:
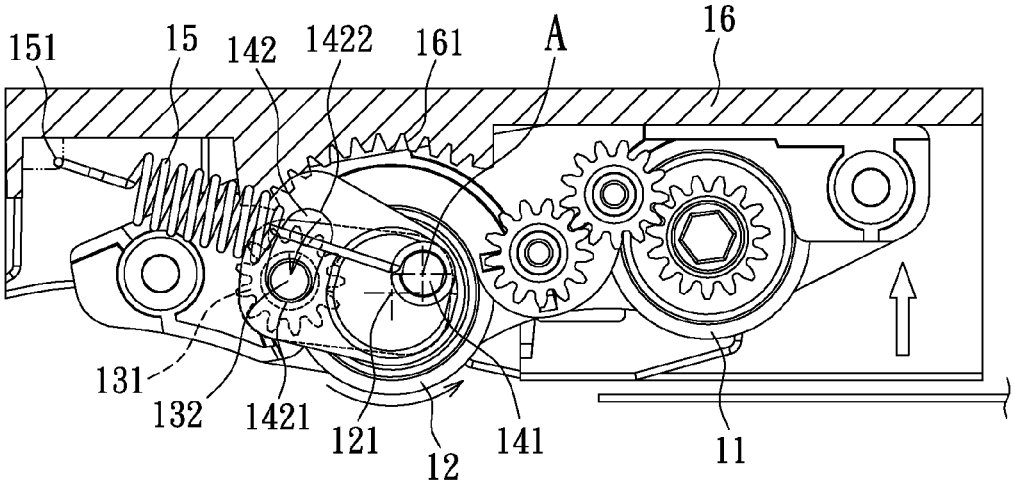

When the paper-feeding process terminates, the driving spindle 17 driven by the motor rotates the second feed roller 12 and the swing gear arm 13 counterclockwise along the second direction. The swing gear 131 of the swing gear arm 13 engages with the gear portion 161 to generate the counterclockwise driving force which is the second directional driving force. For example, the protrusion 132 of the swing gear arm 13 forces on the second end 1422 of the arc slot 142 in order to rotate the swing gear lever 14 counterclockwise. Via the linkage of the eccentric spindle 141 to the part of action 15, the eccentric spindle 141 restores clockwise and moves from the pick-up position B to the non-pick-up position A. The elastic resistance F applied to the non-pick-up position A, as illustrated in FIGS. 3D and 4A, is defined a counterclockwise torque to the axis 121, which is a negative torque, and lift the pick-up rack 10 up to swing the pick-up rack 10 to the non-pick-up position A. The first feed roller 11 stays away from the media of the paper.

Consequently, the present invention has following advantages.

First, the media pick system according to the present invention has simple structure and modularized design. The media pick system would alternatively switch the direction between the positive torque and negative torque so that the pick-up rack can be lifted up for being away the media or pushed down for touching the media to complete the media feeding process. Moreover, the design of the present invention would reduce the cost of manufacturing the pick system mechanism and size down the body of printers. In addition, the media pick system would increase the success rate of paper feeding process.

Second, the media pick system according to the present invention could save more energy comparing with the conventional media pick system since the pick system of the present invention would not need full power supply from the motor.

The descriptions mentioned above merely represent the preferred embodiment of the present invention, without any intention to limit the scope of the present invention. Various equivalent changes, alternations or modifications based on the claims of present invention are all consequently viewed as being embraced by the scope of the present invention.

What is claimed is:

1. A media pick system comprising:

a pick-up rack swinging between a pick-up position and a non-pick-up position and having a first feed roller and a second feed roller;

a swing gear arm linked to the second feed roller and having a swing gear arranged thereon; and a swing gear lever having an end connected to the swing gear arm and an another end connected to a part of action, wherein the swing gear arm includes a protrusion, the swing gear lever includes an arc slot, the protrusion movably engages with the arc slot;

whereby the second feed roller and the swing gear arm rotate toward a first direction, the swing gear of the swing gear arm engages with a gear portion so as to drive the swing gear lever to actuate the part of action while the swing gear lever rotates toward the first direction; the part of action forces the pick-up rack to swing to the pick-up position, so that the first feed roller contacts paper;

the second feed roller and the swing gear arm rotate toward a second direction, the swing gear of the swing gear arm engages with the gear portion so as to drive the swing gear lever to restore the part of action while the swing gear lever rotates toward the second direction; the part of action forces the pick-up rack to swing to the non-pick-up position, so that the first feed roller goes away from the paper.

2. The media pick system according to claim 1, wherein the arc slot defines a first end and a second end; when the swing gear of the swing gear arm engages with the gear portion along the first direction, the protrusion moves toward and forces the second end of the arc slot so as to generate a first-directional driving force; when the swing gear of the swing gear arm engages with the gear portion along the second direction, the protrusion moves toward and forces the first end of the arc slot so as to generate a second-directional driving force.

3. The media pick system according to claim 2, wherein the part of action is a spring.

4. The media pick system according to claim 2, wherein the second feed roller connects to a driving shaft.

5. The media pick system according to claim 2, further including a lid disposed over the pick-up rack, and the gear portion being arranged at an inner face of the lid.

6. The media pick system according to claim 2, further including a cover assembled to a lateral side of the pick-up rack, the swing gear lever penetrating through the cover.

7. The media pick system according to claim 1, wherein the second feed roller has an axis, the swing gear lever has an eccentric spindle on the another end, and the part of action connects to the eccentric spindle, the eccentric spindle moves to a first position relative to the axis to form a clockwise torque about the axis, the eccentric spindle moves to a second position relative to the axis to form a counter-clockwise torque about the axis.

* * * * *